United States Patent [19]

Narva

[11] 4,039,435

[45] Aug. 2, 1977

[54] UNITARY COMPARTMENTALIZED CONTAINER

[76] Inventor: Sydney Paul Narva, 367 Echo Valley Lane, Newtown Square, Pa. 19073

[21] Appl. No.: 639,765

[22] Filed: Dec. 11, 1975

[51] Int. Cl.[2] ..... B65D 77/20

[52] U.S. Cl. ..... 206/217; 206/519; 220/354; 229/1.5 B; 426/115

[58] Field of Search ..... 215/6; 426/86, 115; 220/348, 354, 63 R, 65 R; 229/1.5 B; 206/219, 217, 221, 519, 520

[56] References Cited

U.S. PATENT DOCUMENTS

| | | | |
|---|---|---|---|
| 1,483,015 | 2/1924 | Schnackenberg | 206/217 |
| 1,709,168 | 4/1929 | Epperson | 426/86 |
| 1,889,111 | 11/1932 | Serr | 206/217 |
| 1,933,468 | 10/1933 | Abbot | 206/217 |
| 2,858,041 | 10/1958 | Robinson | 220/90.4 |
| 2,972,406 | 2/1961 | Mayer | 206/219 |
| 3,052,371 | 9/1962 | Bemmelen | 220/354 |
| 3,066,687 | 12/1962 | Rohmann | 215/6 |
| 3,186,850 | 6/1965 | Anthony | 426/86 |
| 3,407,922 | 10/1968 | Palmer | 206/217 |
| 3,561,664 | 2/1971 | Palmer | 229/1.5 B |
| 3,915,296 | 10/1975 | Spencer | 206/217 |
| 3,920,120 | 11/1975 | Shveda | 229/1.5 B |

FOREIGN PATENT DOCUMENTS

| | | | |
|---|---|---|---|
| 737,288 | 6/1966 | Canada | 206/217 |
| 884,473 | 7/1953 | Germany | 206/217 |

*Primary Examiner*—William Price
*Assistant Examiner*—Bruce H. Bernstein
*Attorney, Agent, or Firm*—Robert E. Burns; Emmanuel J. Lobato; Bruce L. Adams

[57] ABSTRACT

A container assembly for storing a predetermined quantity of foodstuff, medication or the like product comprises a unitary container divided into upper and lower compartments and having a circumferential inner sidewall portion encircling the container interior and dividing it into the two compartments. The product is prefilled in the lower compartment and a closure member fits within the container and coacts therewith to hermetically seal the product within the lower compartment. In one embodiment, the closure member has an annular depending lip which engages in a complementary groove in the container sidewall to seal the lower compartment, and in an alternative embodiment, the closure member has on its underside a ring of adhesive material which adheres to a complementary surface portion of the container sidewall to effectively seal the lower compartment. The closure member has a foldable pull-tab attached at the center thereof which is foldable along one fold line to extend along the upper face of the closure member to the container inner sidewall and foldable along another fold line to extend upwardly along the sidewall to a location proximate the container rim. The pull-tab lies flush along the inner sidewall of the container so as not to interfere with stacking of the container assemblies one upon another.

12 Claims, 7 Drawing Figures

UNITARY COMPARTMENTALIZED CONTAINER

BACKGROUND OF THE INVENTION

The present invention relates to containers for dispensing foodstuff, medications and the like and more particularly to a compartmentalized container having sealed therein a prefilled quantity of product to be dispensed.

There are available today numerous types of dispensing containers which are adapted in one way or another to house a prefilled dosage of product. One family of containers of this type employ container inserts which are filled and sealed with a product at one side and then inserted into a container specially designed to receive the insert. One disadvantage of this type of container is that separate manufacturing steps are involed in filling and sealing the capsular insert and thereafter inserting and securing the capsule to a container. It is also necessary to transport the container shells and the filled container capsules to a common site for assembly and in view of the relatively fragile nature of these items, considerable care and expense is required in order to prevent breakage. Another drawback is that when containers of this type are used in vending machines, it is necessary to compactly stack the containers and the container inserts tend to increase the overall container size thereby making them unsuitable for use in vending machines.

Another family of containers of this type comprise generally unitary containers which are sub-divided into compartments, one of which houses the dose of product and the other of which is provided to receive a liquid for mixing with the product. The major drawback of this type container is that relatively intricate devices have been employed to break the seal between the two compartments in order to effect mixing of the liquid and product thereby making these containers expensive. The particular devices employed are awkward and cumbersome to use and often times render the container unsuitable for use for many purposes. Moreover, if the containers are to be suitable for use in vending machines, the devices must be designed so as to enable compact container stacking without damaging the devices or the containers. Difficulties have also been encounterd in effecting a liquid-tight seal between the two compartments so as to avoid contamination of the product yet permit rupture of the seal to enable liquid-product mixing.

SUMMARY OF THE INVENTION

It is therefore a principal object of the present invention to provide a container assembly which satisfactorily overcomes the drawbacks of the prior art containers.

Another object of the invention is to provide a compartmentalized container assembly having two compartments, one of which contains a product and being sealed from the other compartment by a closure member constructed so as to enable compact stacking of the container assemblies in a nested arrangement.

A further object of the invention is to provide a compartmentalized container assembly formed of a unitary container divided into two compartments and a closure member sealing the compartments from one another and wherein the closure member includes a pull-tab lying flush with the container inner wall so that it is readily accessible yet permits close interstacking of the container assemblies.

It is yet another object of the invention to provide a compartmentalized container assembly having a specially shaped product compartment which is shaped to facilitate pouring of the product therefrom to promote quick mixing of the product and liquid.

Another object of the invention is to provide a compartmentalized container assembly divided into two compartments and having an improved closure member for closing and sealing the compartments.

A still further object of the invention is to provide a compartmentalized container assembly which can be inexpensively fabricated and which is rigid and durable in construction so as to withstand packaging, handling and transporting thereof.

The above and other objects of the invention are realized by a container assembly composed of a unitary container having an upper compartment and a lower compartment for receiving and storing the product. A circumferential inner sidewall portion of the container has an annular surface encircling the container interior and which divides it into the two compartments. A closure member fits within the container and has on its underside sealing means coacting with a peripheral portion of the container sidewall so as to form a liquid-tight seal between the two compartments. The closure member has a foldable pull-tab attached at the center thereof which is foldable along one fold line to extend along the upper face of the closure member to the container inner sidewall and foldable along another fold line to extend upwardly along the sidewall to a location proximate the container rim. The pull-tab lies flush along the inner sidewall of the container so as not to interfere with stacking of the container assemblies one upon another.

Having in mind the above and other related objects, features and advantages of the invention that will be apparent from an understanding of this disclosure, the present invention comprises a compatmentalized container assembly as illustrated in the presently preferred embodiments of the invention which are hereinafter set forth in sufficient detail to enable those persons skilled in the art to clearly understand the function, mode of operation and advantages of it when read in conjunction with the accompanying drawings.

DESCRIPTION OF THE PREFERRED EMBODIMENTS

Figure 1:
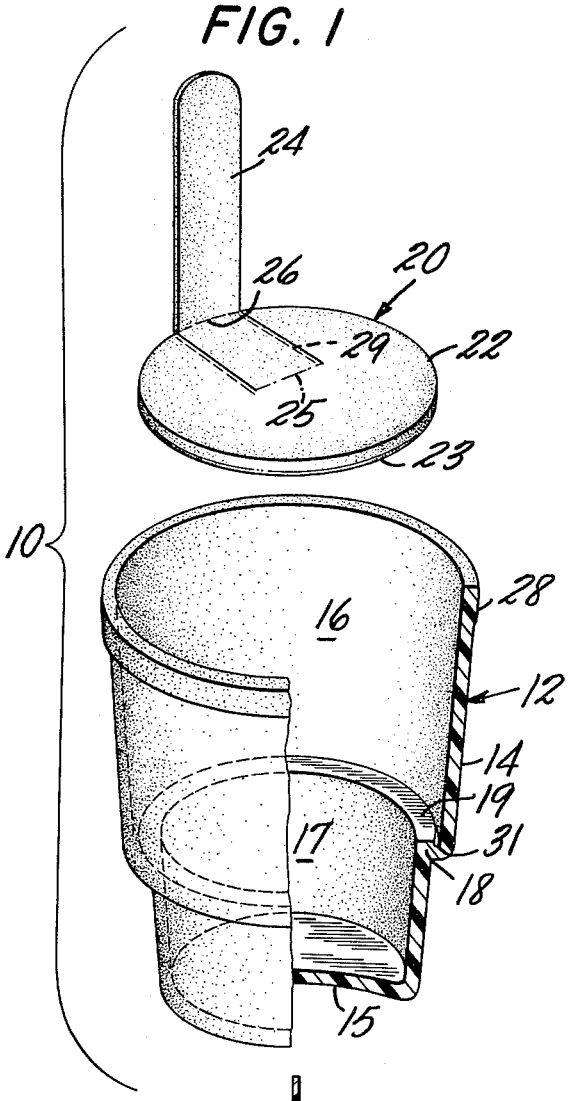
FIG. 1 is a perspective exploded view, partly in section, showing one embodiment of container assembly constructed in accordance with the principles of the invention.

One embodiment of the invention will now be described with reference to FIGS. 1–2. The compartmentalized container assembly 10 consists of a one-piece container 12 having a sidewall 14 and a bottom wall 15 connected to the sidewall thereby closing one end of the container. The container is shaped to form a large, upper compartment 16 and a small, lower compartment 17. The container 12 may be fabricated from any suitable material and is preferably molded of plastic, such as polyethylene, polystyrene or similar foamed synthetic plastic. Lightweight metal such as aluminum as well as paper laminates can also be used though the plastic material is preferred due to its good heat-insulating properties thereby making it well suited for either hot or cold liquids.

The container has a generally frusto-conical configuration and the slight taper enables the containers to be nested one within another. In the embodiment of FIGS. 1–2, the lower compartment 17 is inset relative to the upper compartment 16 so that the container has a stepped configuration. At the transistion region between the upper and lower compartments, the container sidewall has a radially inwardly extending sidewall portion 18 defining a flat annular surface 19 which separates and defines the boundaries of the two compartments.

A closure member 20 is dimensioned to fit snugly atop the annular surface 19 so as to close the lower compartment and seal the product therein. As seen in FIG. 1, the closure member 20 comprises a disk 22 which may be formed of plastic material like that of the container or may be formed of paper stock, aluminum or other metal foil, or a combination of such materials. According to one aspect of the invention, means are provided on the underside of the disk 22 for engaging with complementary means on the container sidewall to hermetically close the lower compartment and form a liquid-tight seal therewith. The sealing means comprises an annular lip 23 which depends from the underside of the disk 22 and which is solid throughout and configured to engage with a snap-fit within an annular groove 31 formed between the annular surface 19 and the inner sidewall of the container 12. The snap-fit is achieved by forming the width of the annular lip 23 slightly oversized with respect to the width of the groove 31 so that the annular lip must be forced or wedged into the groove and slightly compressed inwardly in order to seat the closure member 20 upon the top of the annular surface 19. When the closure member is seated in this fashion, the lower compartment is hermetically sealed so that foodstuffs, medications and the like can be safely stored therein.

In accordance with another aspect of the invention, the closure member 20 is provided with a unique pull-tab 24 for effecting removal of the closure member from the container. The pull-tab 24 is provided with fold lines 25 and 26 which are positioned along the pull-tab at preselected locations to enable the pull-tab to be folded so that it lies along the top face of the closure member and upwardly along the inner sidewall of the container. In the embodiment shown, the fold lines comprise weakened portions of the pull-tab 24 and the weakened portions serve as fold lines and ensure that the pull-tab folds at these predetermined positions. The fold line 25 is situated at the center of the closure member and the fold line 26 is situated at a location where the pull-tab meets the container inner sidewall so that the pull-tab can be folded about the fold line 26 and extend upwardly along the inner sidewall.

Figure 2:
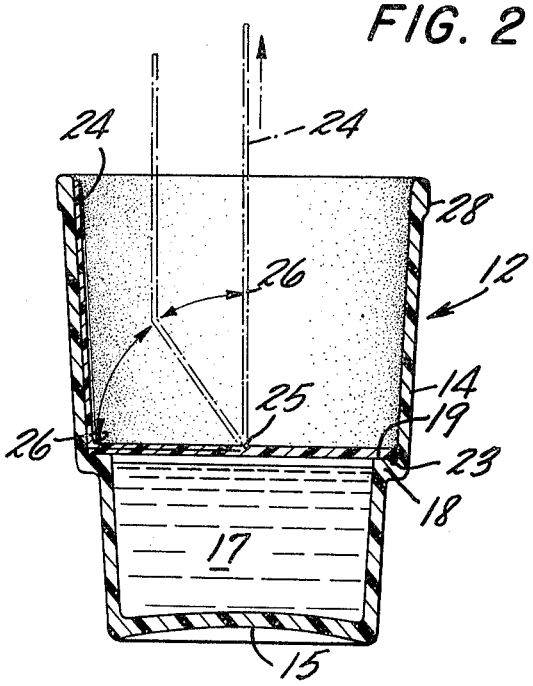
FIG. 2 is a side elevational view, in cross-section, of the container assembly shown in FIG. 1 and showing the progressive stages of movement of the pull-tab during removal of the closure member.

The folded state of the pull-tab 24 is shown in solid line in FIG. 2 from which it can be seen that when the closure member 20 is in place to close and seal the lower compartment, the pull-tab 24 extends from the center of the closure member radially outwardly to the container inner sidewall and then upwardly along the inner wall to a point proximate the rim 28 of the container. In addition, a recess 29 is provided in the top surface or topside of the closure member to accommodate therein that portion of the pull-tab which overlies the closure member so that the pull-tab lies flush with the closure member top surface when in its folded state. By such a construction, the pull-tab does not interfere with the stacking of successive container assemblies one within another. An alternative pull-tab construction comprises simply a pull-tab attached to the periphery of the closure member without the fold lines or the recess.

During use of the container assembly of FIGS. 1–2, a dose of product such as foodstuff concentrate or medication, in granular, paste or liquid form, is charged into the lower or product compartment 17. The product compartment 17 may be filled with any measured quantity or dose of product. After charging of the product in the compartment 17, the closure member 20 is seated in place and when firmly seated, the coaction between the annular lip 23 and the groove 31 effectively seal the product compartment in an air-tight manner. The resultant container assembly is then ready for shipment to any desired location.

When it is desired to use the product, the closure member 20 is manually pulled upwardly, as shown in broken lines in FIG. 2. As the pull-tab 24 is pulled upwardly, it begins to unfold along the fold lines 25 and 26 until the pull-tab reaches its completely unfolded state. If sufficient force is applied, the closure member 20 will snap free of the container 10 thereby exposing the product for use. If the product is a foodstuff concentrate, a suitable liquid may be added to the container and mixed with the product to form the desired liquid. If the product is a medication, it may either be mixed with a liquid or administered directly to the patient. The final use of the container will, of course, depend upon the type product container therein.

Figure 3:
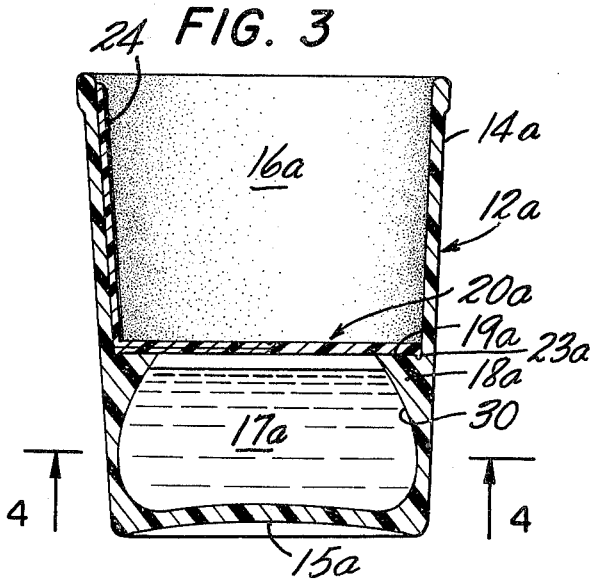
FIG. 3 is a side elevational view, in cross-section, of another embodiment of container assembly constructed in accordance with the principles of the invention.

Another embodiment of the invention is shown in FIG. 3 and for ease of understanding, parts which are similar to those in the embodiment of FIGS. 1–2 are depicted with the same reference number followed by the suffix *a*. In this embodimemt, the outer profile of the container is continuous and does not have a stepped portion like that shown in FIGS. 1–2. In this embodiment, the container assembly is provided with means for facilitating the pouring of the product from the product compartment to the upper compartment thereby simplifying the mixing of the product with the intended liquid. This feature of the invention is particularly advantageous if the product has a syrupy consistency or if it is granular. This means comprises an arcuate inner sidewall portion 30 of the container which extends from the peripheral edge of the sidewall annular surface 19*a* downwardly towards the bottom wall 15*a*. The arcuate portion 30 is concaved outwardly and forms a smooth surface so that when the container is tipped from its normal upright position, the product contained within the lower compartment 17*a* flows freely to the upper compartment 16*a*. As may readily be seen from FIG. 3, the radially inwardly extending sidewall portion 18*a* is completely solid so that no recesses exist beneath the annular surface 19*a* thereby ensuring the free flow of product. By such a construction, the container assembly of the invention avoids the drawback of prior art container construction which employ an annular flange and the like which inhibit the product flow and tend to trap the product beneath the flange.

In this embodiment, the sealing means for sealing the lower compartment 17*a* is similar to that of the embodiment of FIGS. 1 and 2 and comprises an annular lip 23*a* depending from the underside of the closure member 20*a* and engageable in an annular groove 31*a* provided around the annular surface 19*a*.

Figure 4:
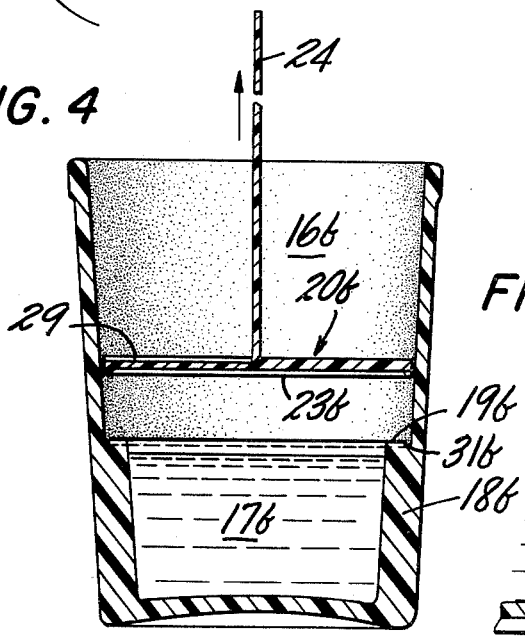
FIG. 4 is a side elevational view, in cross-section, of another embodiment of container assembly constructed in accordance with the principles of the invention and depicting the closure member in the process of being removed from the container.

Another embodiment of the invention is shown in FIG. 4 and for ease of explanation, parts like those of the embodiment shown in FIGS. 1–2 are identified by the same reference number with the additional suffix *b*. In this embodiment, the container 12*b* has a smooth tapered outer profile and the radially inwardly extending sidewall portion 18*b* is uniform throughout the length of the lower compartment 17*b*. In all other respects, the container is alike that shown in FIGS. 1–2.

In accordance with a modified form of the invention, the container assembly may employ another type of sealing means than that disclosed in the heretofore described embodiments. For example, the sealing means can take the form of an adhesive material contained on the underside of the closure member and which adheres to a peripheral sidewall portion of the container interior so as to seal the container lower compartment. Such a modification for each of the embodiments of FIGS. 2, 3 and 4 is shown respectively in FIGS. 2A, 3A and 4A.

Figure 2A:
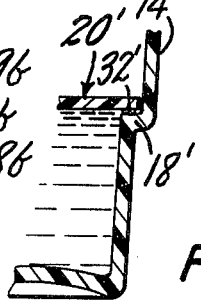
FIG. 2A is a fragmentary side elevational view, in cross-section, showing a modified form of the container assembly shown in FIG. 2.

As seen in FIG. 2A, the sealing means comprises an annular ring of adhesive material 32′ secured to the underside of the closure member 20′. The sidewall portion 18′ of the container is provided with complementary means in the form of an annular, flat surface which sealingly engages with the ring 32′. The ring 32′ is formed of any suitable adhesive material and may be pressure-sensitive or heat-sensitive or may comprise a rubber ring covered with an adhesive coating.

Figure 3A:
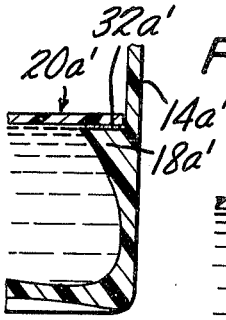
FIG. 3A is a fragmentary side elevational view, in cross-section, showing a modified form of the container assembly shown in FIG. 3.
Figure 4A:
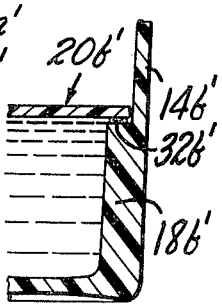
FIG. 4A is a fragmentary side elevational view, in cross-section, showing a modified form of the container assembly shown in FIG. 4.

In a similar fashion, the modification shown in FIG. 3A employs an adhesive ring 32*a*′ in place of the coacting lip and groove arrangement of FIG. 3 and the modification shown in FIG. 4A employs an adhesive ring 32*b*′ in place of the lip and groove arrangement of FIG. 4. In all other respects, the container assemblies of FIGS. 2A, 3A and 4A are identical to those shown in FIGS. 2, 3 and 4, respectively.

The container assembly has been described with reference to several preferred embodiments thereof and it is understood that modifications and changes thereto will become evident to those skilled in the art and the invention is intended to cover all such obvious modifications and changes which fall within the spirit and scope of the invention as defined in the appended claims.

What I claim is:

1. A container assembly for hermetically storing a product dosage comprising: a container having a sidewall and a bottom wall connected to said sidewall thereby closing one end of the container, said container sidewall having around its interior a radially inwardly extending sidewall portion defining an annular surface which divides said container into upper and lower compartments; and a closure member insertable into said container defining therewith a container assembly and dimensioned to overlie and directly contact the sidewall annular surface when said closure member is in a predetermined position thereby closing said lower compartment while leaving open said upper compartment so that a product dosage can be stored within said lower compartment during use of the container assembly, said closure member having an annular lip depending from its underside coacting with means on said sidewall portion defining an annular groove dimensioned to receive therein said annular lip for hermetically sealing said lower compartment when said closure member is in said predetermined position, said annular lip being solid throughout and having a width slightly wider than that of said annular groove and being composed of compressible material so that said lip compresses inwardly and engages with said groove with a snapfit when said closure member is in said predetermined position, and manually graspable means attached to the top side of said closure member for effecting manual removal thereof from said container to enable access to the product dosage within said lower compartment.

2. A container assembly according to claim 1; wherein said annular groove extends between said container sidewall portion and the lowermost portion of the container sidewall inner surface of said upper compartment.

3. A container assembly according to claim 1; wherein said manually graspable means comprises a foldable pull-tab connected at one end to the topside of said closure member and foldable to lie along the topside surface radially outwardly to the sidewall inner surface and then upwardly along said sidewall inner surface towards the container rim.

4. A container assembly according to claim 3 wherein said closure member has on its topside a recess dimensioned to accommodate therein that portion of said pull-tab which overlies said closure member so that said pull-tab portion lies flush with the closure member top surface.

5. A container assembly according to claim 1; wherein said container lower compartment includes means for facilitating pouring of the product stored therein in response to tipping of said container from its normal upright position.

6. A container assembly according to claim 5; wherein said means for facilitating pouring comprises an arcuate inner sidewall portion within said lower compartment extending from the peripheral edge of said sidewall annular surface downwardly towards said bottom wall.

7. In combination: a container having a sidewall and a bottom wall connected to said sidewall thereby closing one end of the container, said container sidewall having around its interior a radially inwardly extending sidewall portion defining an annular surface which divides said container into upper and lower compartments; a predetermined quantity of product to be dispensed stored in said lower compartment; and a closure member overlying and directly contacting the sidewall annular surface thereby closing said lower compartment while leaving open said upper compartment, said closure member having an annular lip depending from its underside coacting with means on said sidewall portion defining an annular groove dimensioned to receive therein said annular lip for hermetically sealing said lower compartment said annular lip being solid throughout and having a width slightly wider than that of said annular groove and being composed of compressible material so that said lip compresses inwardly and engages in said groove with a snap-fit, and manually graspable means attached to the topside of said closure member for effecting manual removal thereof from said container to enable access to the product stored within said lower compartment.

8. A combination according to claim 7; wherein said annular groove extends between said container sidewall portion and the lowermost portion of the container sidewall inner surface of said upper compartment.

9. A combination according to claim 7; wherein said manually graspable means comprises a foldable pull-tab connected at one end to the topside of said closure member and foldable to lie along the topside surface radially outwardly to the sidewall inner surface and then upwardly along said sidewall inner surface towards the container rim.

10. A combination according to claim 9; wherein said closure member has on its topside a recess dimensioned to accommodate therein that portion of said pull-tab which overlies said closure member so that said pull-tab portion lies flush with the closure member top surface.

11. A combination according to claim 7; wherein said container lower compartment includes means for facilitating pouring of the product stored therein in response to tipping of said container from its normal upright position.

12. A container assembly according to claim 11; wherein said means for facilitating pouring comprises an arcuate inner sidewall portion within said lower compartment extending from the peripheral edge of said sidewall annular surface downwardly towards said bottom wall.

* * * * *